US007828065B2

(12) United States Patent
Ross et al.

(10) Patent No.: US 7,828,065 B2
(45) Date of Patent: Nov. 9, 2010

(54) APPARATUS AND METHOD OF STABILIZING A FLOW ALONG A WELLBORE

(75) Inventors: Donald W. Ross, Houston, TX (US); Nashat Nustafa Jamil Hassan, Al-Khobar (SA); Muhammad Shafiq, Al-Khobar (SA); Mohammad Athar Ali, Al-Khobar (SA); Anwar Ahmet Maher Assal, Sugar Land, TX (US); Yasser Mahmoud El-Khazindar, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 317 days.

(21) Appl. No.: 11/861,346

(22) Filed: Sep. 26, 2007

(65) Prior Publication Data

US 2008/0251260 A1 Oct. 16, 2008

Related U.S. Application Data

(60) Provisional application No. 60/911,295, filed on Apr. 12, 2007.

(51) Int. Cl.
*E21B 34/06* (2006.01)

(52) U.S. Cl. ..... 166/373; 166/375; 166/386; 166/54

(58) Field of Classification Search ..... 166/373, 166/375, 386, 54, 319, 53, 313, 50, 250.15; 251/57, 12

See application file for complete search history.

(56) References Cited

U.S. PATENT DOCUMENTS

| | | | | |
|---|---|---|---|---|
| 4,452,311 | A | 6/1984 | Speegle | |
| 5,238,070 | A * | 8/1993 | Schultz et al. | 166/386 |
| 6,119,780 | A * | 9/2000 | Christmas | 166/313 |
| 6,328,112 | B1 | 12/2001 | Malone | |
| 6,848,509 | B2 | 2/2005 | Myerley | |
| 7,108,073 | B2 | 9/2006 | Patel | |
| 7,182,139 | B2 | 2/2007 | Rayssiguier | |
| 7,191,844 | B2 | 3/2007 | Kenison | |
| RE39,583 | E | 4/2007 | Upchurch | |
| 7,243,726 | B2 | 7/2007 | Ohmer | |
| 7,267,177 | B2 | 9/2007 | Patel | |
| 2002/0189815 | A1 * | 12/2002 | Johnson et al. | 166/373 |
| 2003/0221836 | A1 * | 12/2003 | Gardes | 166/369 |
| 2004/0050555 | A1 * | 3/2004 | Rayssiguier et al. | 166/374 |
| 2004/0055750 | A1 * | 3/2004 | Restarick et al. | 166/313 |
| 2006/0207763 | A1 * | 9/2006 | Hofman | 166/281 |

* cited by examiner

*Primary Examiner*—Kenneth Thompson
*Assistant Examiner*—Cathleen R Hutchins
(74) *Attorney, Agent, or Firm*—Rodney V. Warfford; David G. Matthews; Trop, Pruner & Hu, PC

(57) ABSTRACT

A system that is usable with a well includes a closed loop network that is located entirely downhole in the well. The system also includes valves that are located in a wellbore of the well and are interconnected by the closed loop network. Each valve is associated with a different isolated region of the wellbore and is adapted to regulate a flow through the valve based at least in part on a flow condition of the isolated region associated with the valve and a flow condition of each of the other isolated regions.

16 Claims, 4 Drawing Sheets

APPARATUS AND METHOD OF STABILIZING A FLOW ALONG A WELLBORE

This application claims the benefit under 35 U.S.C. §119 (e) to U.S. Provisional Application Ser. No. 60/911,295, entitled, "DOWNHOLE PASSIVE FLOW PROFILING STABILIZER," which was filed on Apr. 12, 2007, and is hereby incorporated by reference in its entirety.

BACKGROUND

The invention generally relates to stabilizing a flow along a wellbore.

For purposes of producing well fluid from a particular wellbore, a string may be run into the wellbore; and isolation zones, or segments, may be created by setting packers of the string. In this regard, when set, each packer forms a corresponding annular seal between the string and the wellbore wall or casing string (if the wellbore is cased). The string may receive incoming well fluid in each of the isolated segments.

Without compensation, the incoming flow distribution along the string may be non-uniform, as the pressure drop across the string inherently changes along the string's length. Furthermore, the flow non-uniformity may also be attributable to variations in reservoir conditions along the wellbore.

A generally uniform, or stabilized, flow into the string permits a maximum reservoir sweep and improves the overall oil production. Furthermore, an uneven flow introduces the possibility of crossflow, which may damage the reservoir. A uniform flow is also beneficial when the flow is an injection flow, which is directed out of the string and into the well.

Conventionally, the string may include flow control devices called chokes for purposes of attempting to stabilize the incoming flow. As an example, in each isolated segment, the string may contain a choke that has an adjustable cross-sectional flow path for purposes of controlling communication between the string and the well. The settings of the chokes (i.e., the cross-sectional flow areas) along the string may be varied in an attempt to achieve a uniform flow distribution. The chokes may be pre-set before the string is run into the well. After the string is in place in the well, the choke settings may be changed, for example, by engaging the chokes with a tool (a shifting tool, for example) during an intervention.

SUMMARY

In an embodiment of the invention, a system that is usable with a well includes a closed loop network that is located entirely downhole in the well. The system also includes valves that are located in a wellbore of the well and are interconnected by the closed loop network. Each valve is associated with a different isolated region of the wellbore and is adapted to regulate a flow through the valve based at least in part on a flow condition of the isolated region associated with the valve and a flow condition of each of the other isolated regions.

In another embodiment of the invention, a technique that is usable with a well includes providing valves in a wellbore of the well. Each valve is associated with a different isolated region of the wellbore. The valves are connected together in a closed loop network that is located entirely downhole in the well. The network is used to regulate a flow for each of the valves based at least in part on a flow condition of the isolated region associated with the valve and a flow condition of each of the other isolated regions.

In yet another embodiment of the invention, a system that is usable with a well includes a string and a closed loop network that is located entirely downhole in the well. The string is located in a wellbore of the well and includes packers to establish isolated intervals along the wellbore and valves that are located in the isolated intervals. The valves are interconnected by the closed loop network; and each valve is adapted to regulate fluid communication through the valve between the isolated region in which the valve is located and the string based at least in part on a flow condition of the isolated region and a flow condition of each of the other regions.

Advantages and other features of the invention will become apparent from the following drawing, description and claims.

DETAILED DESCRIPTION

Figure 1:
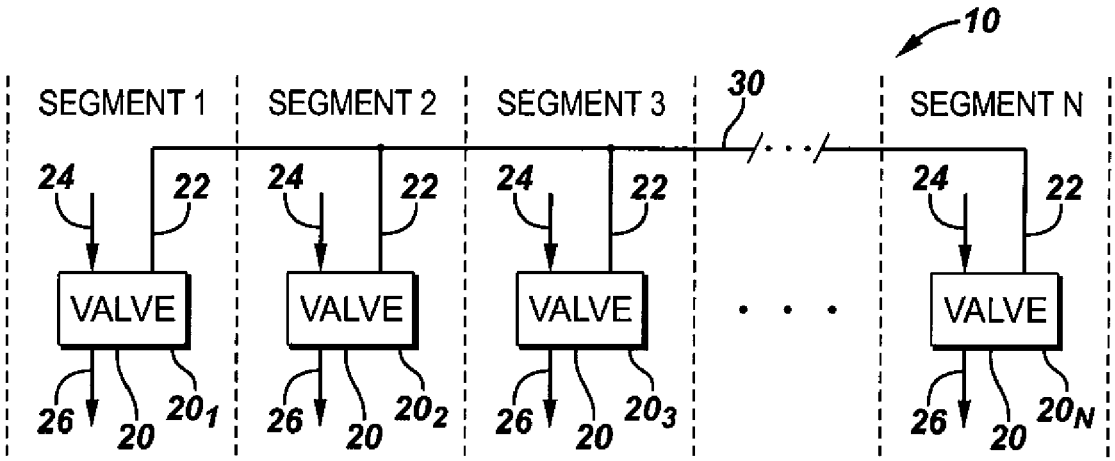
FIG. 1 is a schematic diagram of a system to regulate flow along a wellbore according to an embodiment of the invention.

Referring to FIG. 1, for purposes of stabilizing a flow along a wellbore, a system 10 in accordance with the invention includes a closed loop network, which is formed in part by a communication line 30 that extends between N downhole valves 20 (valves $\mathbf{20}_1$, $\mathbf{20}_2$, $\mathbf{20}_3$ . . . $\mathbf{20}_N$, being depicted in FIG. 1 as examples). Each of the valves 20 is located in a particular isolated region, or segment, of a wellbore. For the example shown in FIG. 1, the wellbore may be partitioned into N isolated segments, with each segment containing a particular valve 20, although each segment may contain more than one valve 20, in other embodiments of the invention. As described further below, the segments may be created by packers that form annular seals between a string (which contains the packers and the valves 20) and a wellbore wall or casing string wall, depending on whether the wellbore is cased.

In accordance with some embodiments of the invention, each valve 20 controls fluid communication between the central passageway of the string and the well for its isolated segment. In general, each valve 20 controls fluid communication between a fluid inlet 24 and a fluid outlet 26 of the valve 20.

The valves 20 may regulate an incoming production flow or may regulate an outgoing injection flow, depending on the particular embodiment of the invention. For embodiments of the invention in which the valves 20 regulate a production flow, the well fluid inlet 24 receives an incoming well fluid flow from the associated segment of the well, and the well fluid outlet 26 provides a well fluid flow from the valve 20 into the central passageway of the string. For embodiments of the invention in which the system 10 regulates an injection flow into the well, the well fluid inlet 24 of each valve 20 receives an injection fluid flow from the central passageway of the string and provides an injection fluid flow at its well fluid outlet 26 into the associated segment of the well.

In order to stabilize flow across the wellbore, each valve 20 regulates its associated flow based on a flow condition (a fluid pressure, for example) of its associated segment, as well as the flow conditions of the other segments. Such an approach achieves a balanced flow across the wellbore, as the valves self-regulate themselves for purposes of stabilizing flow along the wellbore.

In accordance with some embodiments of the invention, the system 10 may be a hydraulic-based system and the communication line 30 may be a hydraulic communication line. In this regard, each of the valves 20, as further described below, may include a compensator, which changes the volume of hydraulic fluid that is retained by the valve, depending on the well fluid pressure in its associated segment. Therefore, depending on how conditions in the wellbore change, the valves 20 adjust the amount of hydraulic fluid supplied to or taken from the communication line 30 to stabilize the flow along the wellbore.

As a more specific example, assuming that the valves 20 are all normally closed valves (i.e., closed if no control pressure is applied), an increase in the well pressure in segment one (see FIG. 1) causes the valve $\mathbf{20}_1$, to increase its cross-sectional flow area and at the same time communicate additional hydraulic fluid to the communication line 30. The communication of the additional hydraulic fluid to the communication line 30, in turn, assuming no other changes occur in the other segments, causes the other valves $\mathbf{20}_2$ to $\mathbf{20}_N$ to generally increase their cross-sectional flow areas. Thus, a particular change in the sensed flow condition in one of the segments causes 1.) the valve in the segment to adjust to the change; and 2.) at the same time causes the other valves 20 in the other segments to adjust to the change.

As examples, depending on the particular embodiment of the invention, the valves 20 may all be normally open; or may all be normally closed. Alternatively, in other embodiments of the invention, some of the valves 20 may be normally open, and other valves 20 may be normally closed. The type (e.g., normally open or normally closed) of the valve 20 that is deployed in a particular segment may depend on the reservoir conditions (permeability, porosity, etc.), which may be determined based on measurements acquired in a prior logging operation (a wireline logging operation, for example).

Figure 2:
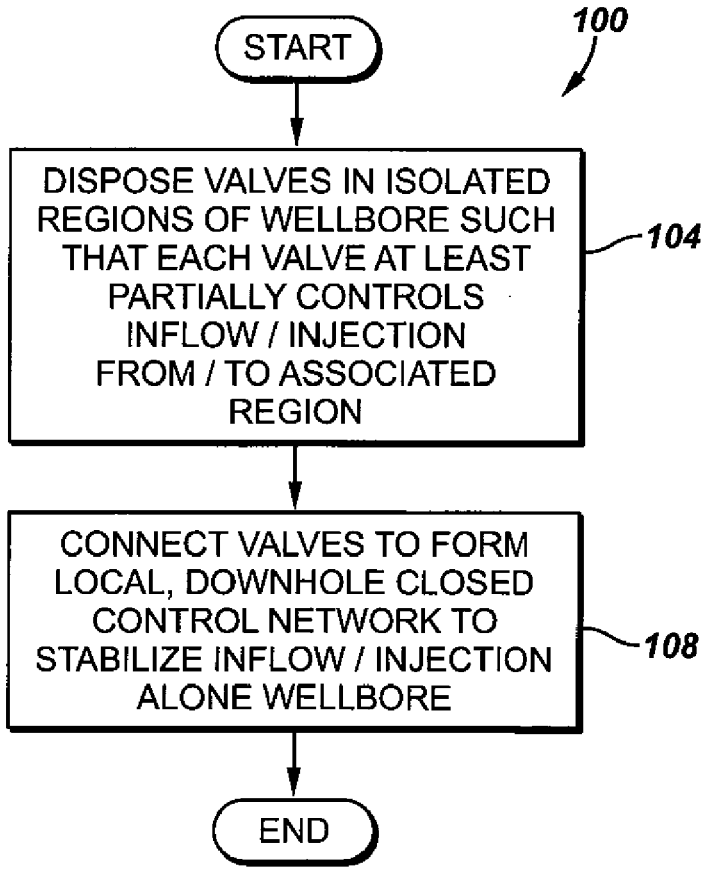
FIG. 2 is a flow diagram depicting a technique to regulate a flow along a wellbore according to an embodiment of the invention.

To summarize, FIG. 2 generally depicts a technique 100 to stabilize flow along a wellbore. Pursuant to the technique 100, valves are disposed (block 104) in isolated regions of the wellbore such that each valve at least partially controls the inflow/injection from/to an associated region of the wellbore. The valves are connected, pursuant to block 108, to form a local, downhole closed, control network to stabilize inflow/injection along the wellbore. The network may be entirely located in the well and may be entirely located in the wellbore, in accordance with some embodiments of the invention.

Figure 3:
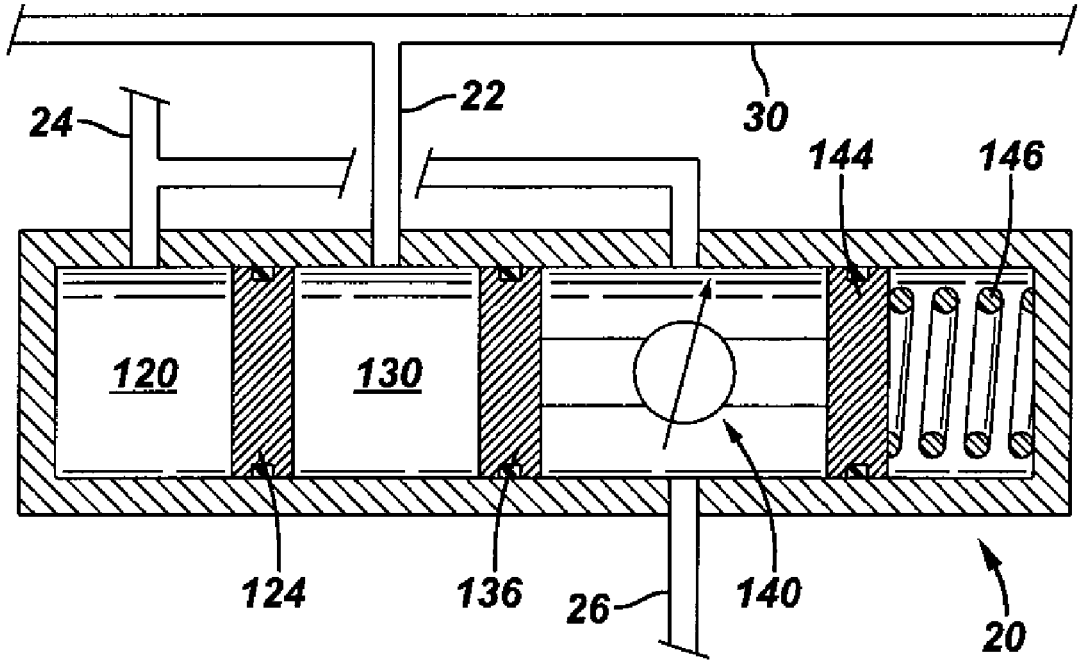
FIGS. 3, 4 and 6 are schematic diagrams of valves according to different embodiments of the invention.

FIG. 3 generally depicts an exemplary structure for the valve 20, in accordance with some embodiments of the invention. The valve 20 depicted in FIG. 3 is a single chamber, hydraulic valve that is controlled by well fluid pressure that is present at the fluid inlet 24. More specifically, as depicted in FIG. 3, the well fluid that is received at the inlet 24 is in fluid communication with chamber 120 of the valve 20. The chamber 120 is part of a compensator, which also includes a floating piston 124 that is disposed between the chamber 120 and a hydraulic chamber 130. The hydraulic chamber 130, in turn, is connected at a port 22 to the communication line 30, which is a hydraulic communication line for this example.

Another piston 136 of the valve 20 is in contact with fluid in the chamber 130 and responds to changes in the volume of the fluid in the chamber 130 to drive a valve flow control element 140. The flow control element 140 controls fluid communication between the fluid inlet 24 and outlet 26 based on the position of the piston 136. As also shown in FIG. 3, the valve 20 may include a compensating return piston 144 that is biased by a spring 146 (a coil spring or gas spring, as examples) to return the valve 20 to its initial state.

Thus, for the arrangement that is depicted in FIG. 3, each valve 20 has a hydraulic port 22 that is connected to the communication line 30 for purposes of integrating the control of the valve 20 with the other control valves 20 in response to the well fluid pressure that is sensed in the various isolated segments along the wellbore.

Figure 4:
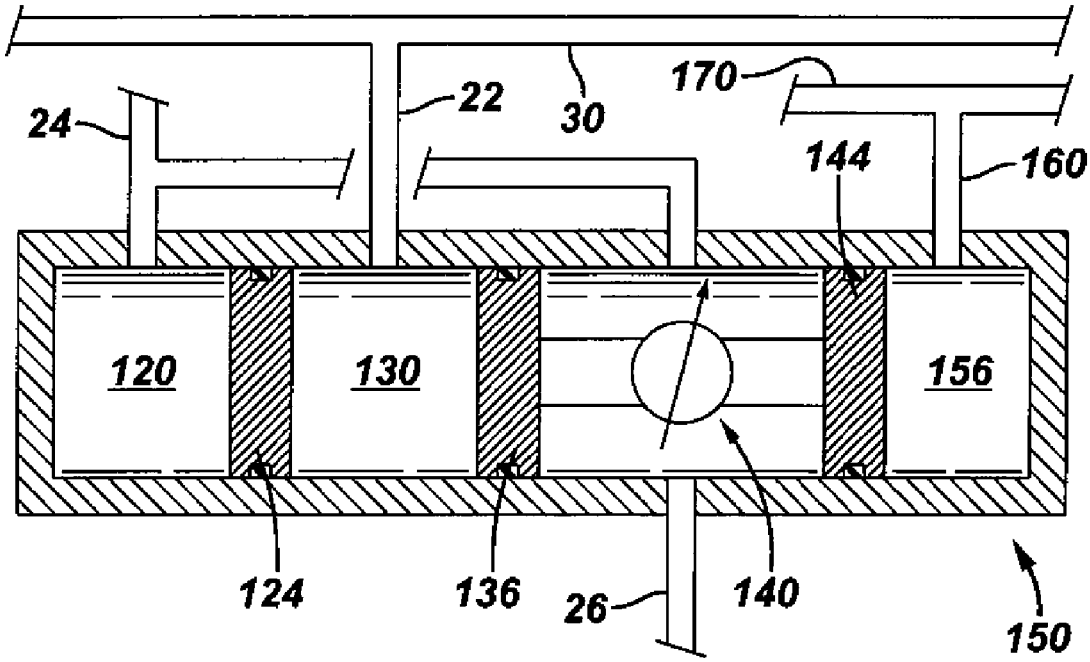

FIG. 4 depicts a hydraulic valve 150 that may be used in place of the hydraulic valve 20 depicted in FIG. 3, in accordance with other embodiments of the invention. The hydraulic valve 150 has the same general design as the valve 20 that is depicted in FIG. 3, with similar components being denoted by the same reference numerals. Unlike the valve 20 of FIG. 3, however, the valve 150 does not include the spring 146. Instead, the valve 150 includes a hydraulic fluid-filled chamber 156 that is in communication via a port 160 to another hydraulic communication line 170. Thus, for embodiments that use dual control line hydraulic valves, such as the valve 150, all of the valves are connected in a network that includes two hydraulic lines 30 and 170. Each line 30, 170 is in fluid communication with one of the hydraulic fluid valve chambers.

Figure 5:
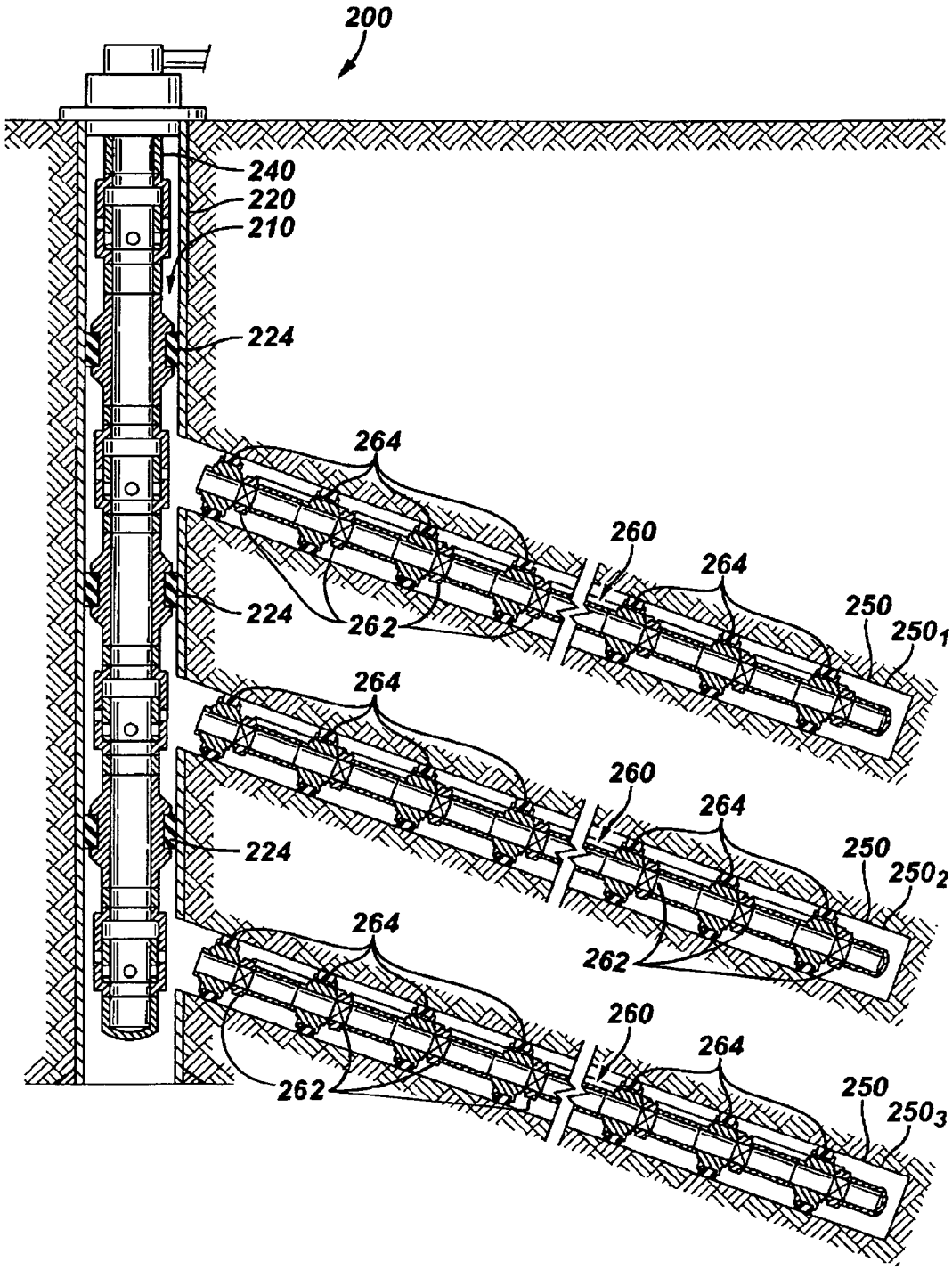
FIG. 5 is a schematic diagram of a well according to an embodiment of the invention.

The above-described control network and valves may be incorporated into a well 200 (a subsea or subterranean well) that is depicted in FIG. 5, in accordance with some embodiments of the invention. In general, the well 200 includes a main, or vertical, wellbore 210 that may be lined with a casing string 220. It is noted that, however, the main wellbore 210 may be uncased in accordance with other embodiments of the invention. In addition to the main wellbore 210, the well 200 also includes various deviated, or lateral wellbores 250 (three wellbores $\mathbf{250}_1$, $\mathbf{250}_2$ and $\mathbf{250}_3$, being depicted as examples in FIG. 5).

In accordance with embodiments of the invention, each lateral wellbore 250 may extend from the main wellbore 210 at a particular junction that is formed between packers 224 of a main tubular string 240 (that is disposed in the main wellbore 210). Furthermore, at this same junction, the tubular string 240 may contain ports to receive production fluid from the associated lateral wellbore 250, for embodiments of the invention in which the wellbore 250 is used for purposes of production. For embodiments of the invention in which the wellbore 250 is used for purposes of injection, the portion of the string 240 between the packers 224 may furnish injection fluid.

As depicted in FIG. 5, in accordance with some embodiments of the invention, each lateral wellbore 250 includes an associated string 260, which generally extends along the length of the wellbore and may hang from an associated junction (not depicted in FIG. 5). The lateral wellbore 250 may be cased or uncased (as depicted in FIG. 5), depending on the particular embodiment of the invention. For embodiments of the invention in which the lateral wellbore 250 is cased, the casing may be perforated before the string 260 is run in hole.

In general, each string 260 includes segments, or compartments, that are formed between packers 264 (when set) of the string 260. The packers 264 may be, as examples, electrically-set packers; mechanically-set packers; hydraulically-set packers; packers formed from swellable materials; inflatable bladder packers; etc., depending on the particular embodiment of the invention. The string 260 also includes valves 262; and the valves 262 are distributed along the string 260 so that each of the compartments that is formed by the packers 264 includes at least one of the valves 262. For each lateral wellbore 250, valves 262 are connected together to form a closed network that is entirely located in the lateral wellbore 250, in accordance with some embodiments of the invention. The valves 262 may have a design similar to the valves that are described herein (such as the valves 20 and 150), although other designs may be used, in accordance with other embodiments of the invention.

Depending on the particular application, for each isolated segment, or compartment, the string 260 may include a sandscreen for purposes of filtering particulates from produced well fluid before the fluid enters the central passageway of the string. For these embodiments of the invention, in each compartment, the incoming well fluid may flow into an annular space between an inner base pipe and the sandscreen; and the valve 262 may be located at a particular portion of the base pipe for purposes of regulating communication of the produced well fluid into the central passageway of the string 260. Alternatively, in accordance with other embodiments of the invention in which the string 260 is used for production, sand screens may not be use, and the produced well fluid may be produced directly through the valves 262.

Other embodiments are within the scope of the appended claims. For example, although a hydraulic closed loop network is disclosed herein, other types of networks (an electrical or optical network, as examples) are contemplated and are within the scope of the appended claims.

Figure 6:
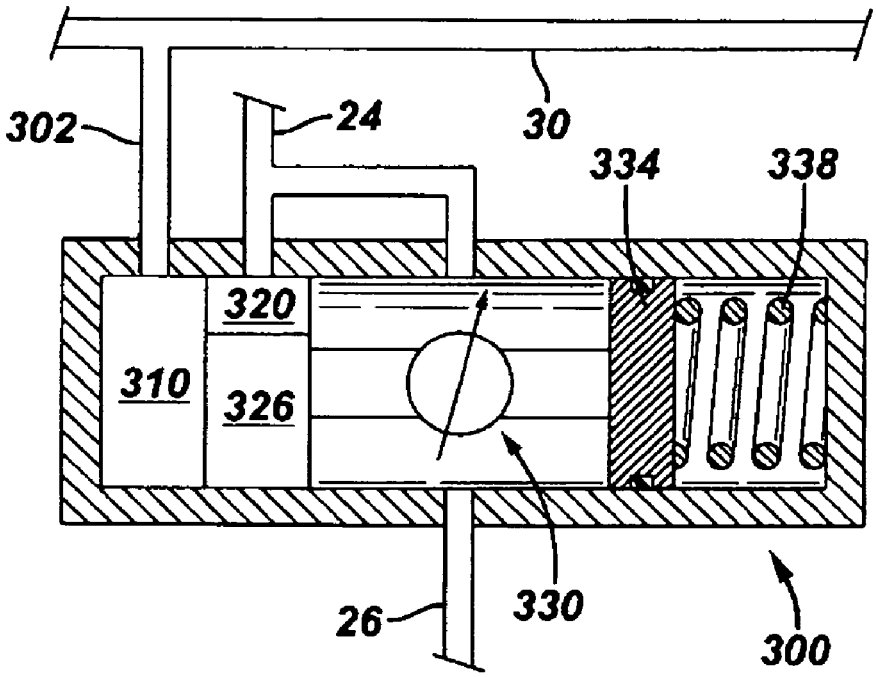

As a more specific example, FIG. 6 depicts an embodiment of an electrically-controlled valve 300, which may be part of an electrical closed loop network, in accordance with other embodiments of the invention. For the valve 300, the communication line 30 (see FIG. 1) is an electrical communication line that communications with an electrical terminal 302 of the valve 300. In this regard, a control unit 310 of the valve 300 may, for example, monitor a well pressure of the associated isolated well segment via a sensor 320 of the valve 300. Based on the detected well pressure, the control unit 310 may change the setting of a valve actuator 326 for purposes of controlling the cross-sectional flow area through the valve 300 by controlling a mechanical valve element 330. As also depicted in FIG. 6, return action may be provided by a piston 334 and spring 338.

The control unit 310 is part of a distributed controller (formed by all of the control units 310) for the network in that the control units 310 of all of the valves 300 cooperate to balance the flow across the wellbore. More specifically, in accordance with some embodiments of the invention, the control units 310 may communicate with each other for purposes of determining an average flow into each of the segments. The communication may involve each control unit 310 communicating the sensed pressure of its associated segment to the other control units 310 of the other valves 300, for example. Based on the determined average flow, the control unit 310 of each valve 300 may then adjust its corresponding cross-sectional flow area for purposes of regulating its flow toward the determined average. Thus, similar to the hydraulic control network, each valve 300 of the electrically-controlled control network is controlled based on a sensed flow condition of the associated segment as well as the flow conditions that are sensed in the other segments of the wellbore.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a well, comprising:

a valve control network, the valve control network being a closed loop network located entirely downhole in the well; and valves located in a wellbore of the well and interconnected by the closed loop network, each valve being associated with a different isolated region of the wellbore and being adapted to regulate a flow through the valve based at least in part on a flow condition of the isolated region associated with the valve and a flow condition of each of the other one or more remaining isolated regions, wherein each valve comprises a compensator to regulate a volume of hydraulic fluid in a control chamber of the valve in response to a pressure of the associated isolated region, and the closed loop network comprises the compensators and a hydraulic control line in communication with the control chamber of each valve.

2. The system of claim 1, wherein each of the valves regulates an inflow from the well into a production tubing based at least in part on a flow condition of the isolated region associated with the valve and the flow condition of each of the other one or more remaining isolated regions.

3. The system of claim 1, wherein each of the valves regulates an injection flow into the well based at least in part on a flow condition of the isolated region associated with the valve and the flow condition of each of the other one or more remaining isolated regions.

4. The system of claim 1, wherein the closed loop network is located entirely in the wellbore.

5. The system of claim 1, further comprising:

packers to form the isolated regions.

6. The system of claim 1, further comprising:

additional valves located in the isolated zones and interconnected by the closed loop network.

7. A method usable with a well, comprising:

providing valves in a wellbore of the well, each valve being associated with a different isolated region of the wellbore;

connecting the valves together in a closed loop network located entirely downhole in the well; and using the network to regulate a flow through each of the valves based at least in part on a flow condition of the isolated region associated with the valve and a flow condition of each of the other one or more remaining isolated regions, the using comprising:

for each valve, regulating a volume of hydraulic fluid in a control chamber of the valve in response to a pressure of the associated isolated region, and providing a hydraulic control line shared in common with the valves to hydraulically connect to the control chamber of each valve.

8. The method of claim 7, wherein the flow comprises an inflow into a string from the well.

9. The method of claim 7, wherein the flow comprises an injection flow from a string and into the well.

10. The method of claim 7, wherein the closed loop network is located entirely in the wellbore.

11. The method of claim 7, further comprising:

providing additional valves located in the isolated zones and interconnected by the closed loop network.

12. A system usable with the well, comprising:

a string located in a wellbore of the well, the string comprising packers to establish isolated intervals along the wellbore and valves located in the isolated intervals; and a valve control network, the valve control network being a closed loop network located entirely downhole in the well, wherein the valves are interconnected by the closed loop network, and each valve being adapted to regulate fluid communication through the valve between the isolated region in which the valve is located and the string based at least in part on a flow condition of the isolated region and a flow condition of each of the other one or more remaining isolated regions, wherein each valve comprises a compensator to regulate a volume of hydraulic fluid in a control chamber of the valve in response to a pressure of the associated isolated region, and the closed loop network comprises the compensators and a hydraulic control line in communication with the control chamber of each valve.

13. The system of claim 12, wherein each of the valves regulates an inflow from the well based at least in part on a flow condition of the isolated region associated with the valve and the flow condition of each of the other one or more remaining isolated regions.

14. The system of claim 12, wherein each of the valves regulates an injection flow into the well based at least in part on a flow condition of the isolated region associated with the valve and the flow condition of each of the other one or more remaining isolated regions.

15. The system of claim 12, further comprising:

another string located in another wellbore of the well; said another string comprising other packers to establish other isolated intervals along said another wellbore and other valves located in said other isolated intervals; and another closed loop network located entirely downhole in the well, wherein said other valves are interconnected by said another closed loop network, and each of said other valves being adapted to regulate fluid communication to said other valve between said other isolated region in which said other valve is located and said another string based at least in part on a flow condition of said other isolated region associated with said other valve and a flow condition of each of the other one or more of the remaining said other isolated regions.

16. The system of claim 12, wherein the packers comprise setable packers.

* * * * *